US008926178B2

(12) United States Patent
Kohen

(10) Patent No.: US 8,926,178 B2
(45) Date of Patent: Jan. 6, 2015

(54) FLEXIBLE TANK FOR THE TRANSPORTATION OF LIQUIDS

(71) Applicant: Yusuf Kohen, Istanbul (TR)

(72) Inventor: Yusuf Kohen, Istanbul (TR)

(73) Assignee: Likua Endüstriyel Ambalaj Malzemeleri San. ve Tic. Ltd. Ş ti (TR)

( * ) Notice: Subject to any disclaimer, the term of this patent is extended or adjusted under 35 U.S.C. 154(b) by 0 days.

(21) Appl. No.: 13/714,639

(22) Filed: Dec. 14, 2012

(65) Prior Publication Data

US 2013/0101237 A1 Apr. 25, 2013

Related U.S. Application Data

(63) Continuation of application No. PCT/TR2010/000143, filed on Jul. 1, 2010.

(30) Foreign Application Priority Data

Jun. 17, 2010 (TR) ..... 2010 04884

(51) Int. Cl.

| | |
|---|---|
| ***B65D 30/22*** | (2006.01) |
| ***B65D 30/08*** | (2006.01) |
| ***B65D 88/00*** | (2006.01) |
| ***B65D 88/22*** | (2006.01) |
| ***B65D 90/04*** | (2006.01) |
| ***B65D 90/52*** | (2006.01) |

(52) U.S. Cl.

CPC ..... *B65D 88/22* (2013.01); *B65D 90/046* (2013.01); *B65D 90/52* (2013.01); *B65D 2590/046* (2013.01); *Y10S 383/904* (2013.01)

USPC ..... 383/38; 383/109; 383/904; 220/1.6

(58) Field of Classification Search

USPC ..... 383/38, 3, 109, 904; 220/721, 1.6; 105/423; 206/522

See application file for complete search history.

(56) References Cited

U.S. PATENT DOCUMENTS 3,250,742 A * 5/1966 dit Michel Nalpas ..... 206/522
3,722,751 A * 3/1973 Bisciglia ..... 222/94

(Continued)

FOREIGN PATENT DOCUMENTS

JP 3256887 11/1991
JP 03256887 A * 11/1991 ..... B65D 88/22

(Continued)

OTHER PUBLICATIONS

Machine translation of WIPO Document No. 2008/135277. Translated on Oct. 31, 2013.*

International Search Report dated Feb. 18, 2011 for international application No. PCT/TR2010/000143.

*Primary Examiner* — Jes F Pascua

(74) *Attorney, Agent, or Firm* — Gardner Groff Greenwald & Villanueva, P.C.

(57) ABSTRACT

A flexible tank having a closed form wherein liquid can be stored and which can carry liquid from one location to the other by means of a vehicle, characterized by comprising a lower compartment and an upper compartment one having smaller width or length than the other and positioned one upon the other so that the liquid transfer in between is at least partially prevented.

15 Claims, 3 Drawing Sheets

(56) References Cited

U.S. PATENT DOCUMENTS

| | | | | |
|---|---|---|---|---|
| 4,890,764 | A * | 1/1990 | Rossini | 220/560.02 |
| 5,727,270 | A * | 3/1998 | Cope et al. | 5/710 |
| 6,726,052 | B1 * | 4/2004 | Miller | 220/666 |
| 8,162,164 | B2 * | 4/2012 | Podd et al. | 220/4.13 |
| 2010/0122981 | A1 * | 5/2010 | Sims | 220/1.6 |

FOREIGN PATENT DOCUMENTS

| | | |
|---|---|---|
| WO | 2008085141 | 7/2008 |
| WO | 2008135277 | 11/2008 |
| WO | 2010056219 | 5/2010 |

* cited by examiner

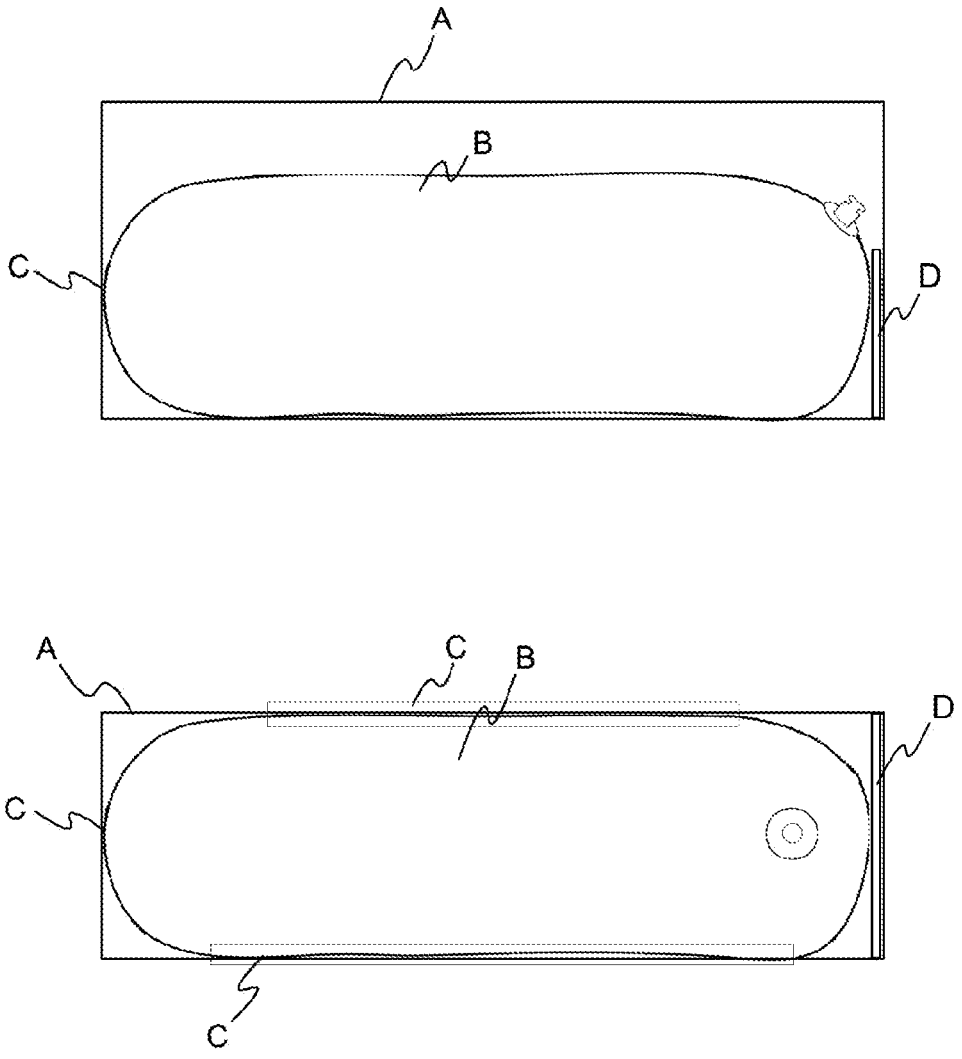
Figure 6 - Prior Art

FLEXIBLE TANK FOR THE TRANSPORTATION OF LIQUIDS

CROSS-REFERENCE TO RELATED APPLICATION

This application is a continuation application of PCT Patent Application Serial No. PCT/TR2010/000143, filed on Jul. 1, 2010, which claims the priority benefit of Turkish Patent Application 2010/04884 filed on Jun. 17, 2010, both of which are hereby incorporated herein by reference.

TECHNICAL FIELD

The present invention relates generally to flexible tanks used in any liquid fluid transportation and especially relates to flexible tanks having a closed form wherein liquid can be stored and which can carry liquid from one location to the other by means of a vehicle.

BACKGROUND

Especially the solutions provided by the flexible big bags in the transportation of the materials in illiquid granule form are used in practice for years. As in granule type materials, the usage of flexible big bag or in more general terms the flexible carriers in the transportation of liquid/liquid based materials can provide beneficial solutions. As a matter of fact, the technical specifications like liquid transportation, impermeability, the filling of the liquid into the transportation medium, the discharging of the liquid from the transportation medium and the preservation of the hygiene quality of this medium and also other factors like minimizing the possible costs related to transportation are important matters which should be taken into consideration primarily.

A solution for the usage of flexible tanks for the storing and the carrying of the liquids is disclosed in GB 2 360 816. In GB 2 360 816, a flexible tank appropriate for liquid transportation comprising a one piece body formed by a co-extrusion blown film technique is disclosed. This one piece body may comprise an inner and an outer liner component and each component may comprise two to four layers. Two holes formed inside the tank can provide the adaptation of the hose inlet and the pressure discharge valve to the tank.

In EP 0 567 383, a fluid storing system comprising a liner fixed by seaming to a thin walled carrier is disclosed. Since the liner is embodied in greater sizes than the thin walled carrier, the possible tensions in the liner seams are reduced.

In U.S. Pat. No. 4,875,596, a tank which has open ends in the form of a tube wherein liquid materials can also be stored and carried and where said ends are seamed tightly by means of straight or line-like clamp connection parts is disclosed. The clamp connection parts are formed toothed rack-like so that, with relatively short clamp connection parts, tubes with relatively large openings can be sealed tightly.

As known in the art, flexible and full tanks are placed into metal containers and their transportation from one location to another is realized in these containers. According to this, as can be seen from the representative figure in FIG. 6 belonging to the prior art, the flexible tank (B) which is full of liquid is compliant with the rectangular prism form of the container (A) as much as possible when the flexible tank is placed into the container (A). Thus, the pressure force resulting from the own weight of the liquid inside the flexible tank (B) is transferred directly to the walls of the container through the contact region (C) between the flexible tank (B) and the container (A).

On the other hand, at least some part of the transportation route and sometimes all of it is realized by means of land vehicles like lorry. During land transportation, the fluctuation is formed resulting from the fluctuation of the liquid inside the flexible tank because of the conditions of the road (ditch cuts, disturbances on the road) and because of the acceleration and the turns realized by the driver of the vehicle. In addition to the present force resulting from the weight of the liquid, by the affect of the force resulting from the hydrodynamic pressure caused by these fluctuations, the pressure force applied to the container walls increases more and this leads to the deformation of the container and in some cases breaks on the walls and this makes the container useless. The parts of the container which are more frequently deformed or broken are the lateral walls and the door of the container.

However, none of the present applications disclosed in the abovementioned patents present a solution to said problem. Since in none of these embodiments, there is a measure to decrease the contact surface between the container and the flexible tank, the pressure forces resulting from the liquid inside the flexible tank and the pressure forces resulting from the fluctuations are transferred to the container walls carrying the tank directly.

On the other hand, in order to prevent the liquid inside the flexible tank to form a movement towards the door opened although the door of the container is opened, a bulkhead is positioned so as to be connected to the container body and so as to be between the container door and the flexible tank. In FIG. 6, the positioning style of said bulkhead (D) is illustrated representatively. The presence of said bulkhead is a disadvantage from a plurality of point of views: For instance, in order for the physical access to the flexible tank, the handset should be disconnected from the container connection, and this causes more labor. On the other hand, the usage of such an additional bulkhead material has a high cost and the abovementioned patents belonging to the present art do not present a solution to this problem.

SUMMARY

In order to eliminate the abovementioned disadvantages, the object of the present invention is to provide a flexible tank applying less pressure to the walls of the container wherein the flexible tank is positioned.

Another object of the invention is to provide a flexible tank which damps the forces resulting from the own weight of the liquid it carries and resulting from the loads arising from the fluctuation of the liquid.

Another object of the invention is to provide the elimination of the bulkhead positioned so as to correspond to the cover part on the containers carrying the flexible tanks wherein liquid or liquid based material is carried/stored.

In order to realize the objects that are obtained from the above mentioned and the below mentioned detailed descriptions, the present invention is a flexible tank having a closed form wherein liquid can be stored and which can carry liquid from one location to the other by means of a vehicle, characterized by comprising a lower compartment and an upper compartment one having smaller width or length than the other and positioned one upon the other so that the liquid transfer in between is at least partially prevented.

In a preferred embodiment of the present invention, said upper compartment has a smaller width and length than the lower compartment.

In another preferred embodiment of the present invention, in order to completely eliminate the contact possibility of any surface of the upper compartment with the container door, said upper compartment is positioned so as to be closer to one side on the lower compartment.

In another preferred embodiment of the present invention, said flexible tank comprises an inner layer defining the lower and the upper compartments.

In another preferred embodiment of the present invention, said inner layer comprises a lower and an upper part fixed to each other so as to define the lower and the upper compartment respectively.

In another preferred embodiment of the present invention, there is at least one passage aperture which provides liquid transfer between the lower compartment and the upper compartment.

In another preferred embodiment of the present invention, said passage apertures are the regions which melt during the welding of the lower and the upper part to each other.

An alternative embodiment of the present invention is so as not to let liquid passage between the lower compartment and the upper compartment. According to this, in order to prevent liquid transfer, a barrier extending lengthwise between the lower and the upper compartment is used. In this alternative embodiment, liquid provision to and discharge from each compartment can be provided by a plurality of ways.

In another preferred embodiment of the present invention, the lower and the upper parts forming said inner layer are made of plastic based material.

In another preferred embodiment of the present invention, said lower and upper parts are made of thermoplastic polypropylene (PP), polyethylene (PE) or PVC.

In another preferred embodiment of the present invention, at least one of said lower and upper parts comprises at least 2 layers with a thickness between 100 and 150 micron.

In an alternative embodiment of the present invention, said flexible tank comprise a single layer which has a substantial thickness which will provide the desired strength and which defines the lower and the upper compartment. According to this, said one layer has a thickness of 900-1100 micron and it is made of plastic based material.

On the other hand, in this alternative embodiment, the present invention comprises connection members connecting the lower and the upper compartment from at least one point in order to substantially stabilize the lower and the upper compartment.

In another preferred embodiment of the present invention, there is an outer layer enclosing said inner layer.

In another preferred embodiment of the present invention, said outer layer is woven polypropylene.

In another preferred embodiment of the present invention, there is at least one connection member whose two ends are fixed to the lateral surfaces of the lower and the upper compartments. Thus, the flexible tank becomes more stabile by limiting the displacement of the upper compartment with respect to the lower compartment.

In another preferred embodiment of the present invention, at least one of the lower or the upper part of the inner layer is seamed to the outer layer from at least one seam point.

In another preferred embodiment of the present invention, at least one of said lower and upper compartments comprises a valve in order to provide liquid transfer to the flexible tank and a protective sheath which covers said valve and which is preferably connected to the inner layer.

BRIEF DESCRIPTION OF THE DRAWINGS

In order to understand the embodiment of the present invention with the additional elements in the best way, it had to be evaluated with the figures that are explained below.

FIG. 6 is a representative view of the prior art.

DETAILED DESCRIPTION OF EXAMPLE EMBODIMENTS

In this detailed explanation, the subject matter flexible tank is explained with figures in order to make the subject more understandable without forming any restrictive effect.

Figure 1:
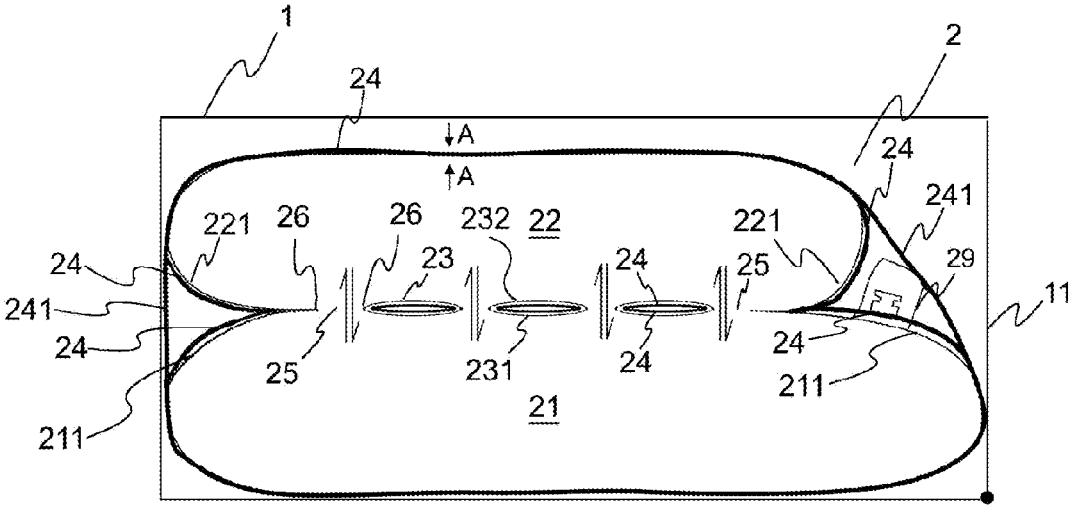
FIG. 1 is the lateral representative view of the flexible tank.
Figure 2:
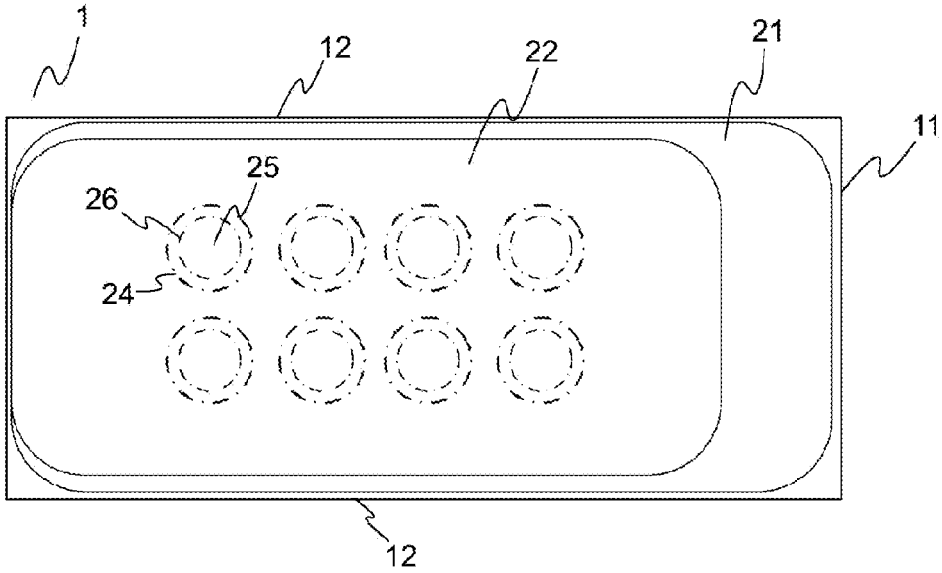
FIG. 2 is the top representative cross sectional view of the flexible tank.

In FIG. 1, the flexible tank (2) as positioned into a container (1) according to the present invention is illustrated. According to this, the subject matter flexible tank (2) comprises a lower compartment (21) placed onto the base of the container and an upper compartment (22) embodied on the lower compartment so that it is smaller than the lower compartment (21). With reference to FIGS. 1 and 2, in order to completely prevent the contact between the flexible tank and the container door (11) which is the weakest part of the container, the upper compartment (22) is not placed on the middle of the of the lower compartment (21), instead of this, it is placed so that there is substantial space on the upper surface of the part of the lower compartment facing the container door (11). In addition to this, with reference to FIG. 2 and FIG. 3, the width and the length of the upper compartment (22) is smaller than the width and the length of the lower compartment (21), the height of the upper compartment can be smaller, equal or bigger than the height of the lower compartment (21).

On the other hand, the upper and the lower compartments (21, 22) are defined by an inner layer (23). Said inner layer (23) comprises a lower part (231) forming the lower compartment (21) and an upper part (232) forming the upper compartment (22). According to this, the lower and the upper compartments (21, 22) are obtained by the positioning of the lower and the upper parts (231, 232) on top of each other which are two separate flexible plates and where one is bigger than the other and by making one each closed form from them prior to the manufacture. Thanks to this, on the parts of the lower and the upper compartments (21, 22) facing each other, the inclined surfaces (211, 221) whose function will be explained later are defined. Afterwards, a plurality of regions on the contact region of the lower and the upper parts (231, 232) are melted as a result of thermal process. Thus, the two parts (231, 232) are welded to each other in sealed manner through the weld point (26) formed by welding the melted material to each other and the flexible tank (2) is obtained.

With reference to FIG. 2, the melted parts on the regions which are subject to said thermal process form the passage apertures (25) so as to let liquid transfer between the lower and the upper compartment (21, 22). In this preferred embodiment of the invention, although eight circular passage apertures (25) on two lines where there are four apertures on each line are formed, in alternative embodiments, the number, form and the dimension of the passage apertures (25) may change optionally.

Figure 3:
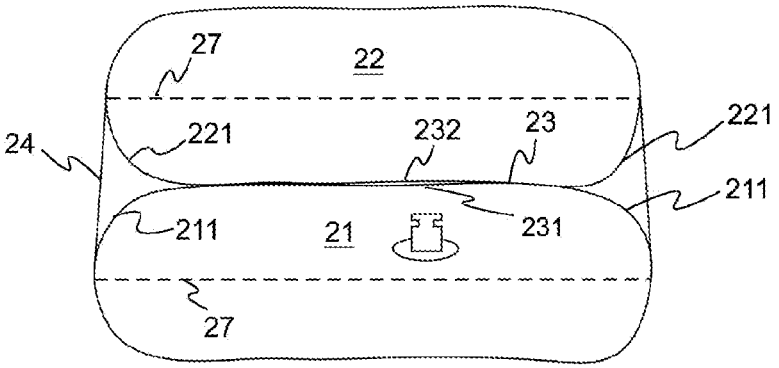
FIG. 3 is the top front representative view of the flexible tank.

With reference to FIG. 1 and FIG. 3, the subject matter flexible tank (2) also comprises an outer layer (24) which encloses the lower and the upper compartments (21, 22). Said outer layer (24) is preferably seamed to the inner layer (23) from at least one each seam point (27) on the lateral surfaces of the lower and the upper parts (231, 232) of the inner layer (23). Thus, the outer layer (24) encloses the lower and the upper compartments (21, 22) so that the compartments extend together with said inclined surfaces (211, 221). During manufacture, the parts of said outer layer corresponding to the passage apertures (25) are cut. Said outer layer (24) is made of big bag material and according to this, it is preferably woven polypropylene. On the other hand, in order to limit the movement of the upper compartment (22) with respect to the lower compartment (21) and thus to make the flexible tank (2) more stabile, so that the outer layer (24) has a separate arm, at least one connection member (241) is seamed to the lateral surfaces of the lower and the upper compartment (21, 22) from two ends. In this preferred embodiment, a couple of connection members (241) are used which are seamed two mutual sides of the flexible tank (2). Said connection member (241) can be a part similar to a strip and plate.

Again with reference to FIG. 1 and FIG. 3, a valve (28) preferably on the upper surface of the part facing the container door (11) of the lower compartment (21) and a protective sheath (29) covering said valve are embodied. Liquid filling-discharge process to/from the flexible tank (2) is realized by means of said valve (28).

Figure 4:
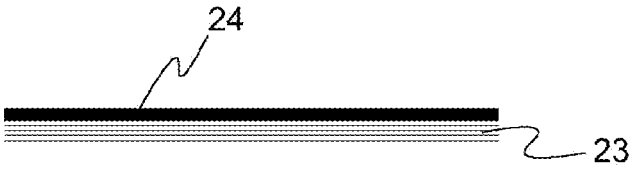
FIG. 4 is the view of the A-A cross section in FIG. 1.

With reference to FIG. 4, the lower and the upper parts (231, 232) forming the inner layer (23) of the flexible tank (2) are composed of 2 layers where each one has a thickness of approximately 125 microns. Each layer is made of preferably a plastic based material and especially a thermoplastic (for instance PP, PE, PVC, Nylon®) material. In alternative embodiments, the number and the thickness of the layer may change.

However, alternatively, the lower and the upper parts (231, 232) forming the inner compartment can be shaped so as to comprise less than or more than 4 layers and for instance, if only one layer is used, a material with an approximate thickness of 1000 micron can be used.

In such an embodiment, in cases where any outer layer made of big bag material is not used, the lower and the upper compartments (21, 22) should be made stabile especially when in motion. Because of this, a plurality of cord or plate shaped connection members (not illustrated in the figure) are connected to the lower and the upper compartment preferably from the lateral surfaces. In more details, said members are again preferably made of nylon material and they are welded to the lower and the upper compartment (21, 22) by thermal weld. Thus, said connection members function as a big bag outer layer.

Under the light of the structural details and the attached figures, the operation of the invention is as follows. When the flexible tank (2) is placed into the container (1), under normal conditions, since the upper compartment (22) has a smaller width and length, it does not contact with the lateral walls (12) and the door (11) of the container (1) which are big, the only contact region of the flexible tank (2) with the container is the narrow area around the lateral surface of the lower compartment (21). Thus, most of the pressure force resulting from the weight of the liquid inside the flexible tank (2) is not transferred to the walls of the container, instead of this, it is transferred to the base of the container through the lower compartment (21) and from there it is transferred to the place (truck chassis, ship, etc.) where the container (1) is positioned. When the lorry travels, the liquid fluctuations which are formed inside the flexible tank (2) and which proceed towards the lateral walls of the container are damped by the inclined surfaces (211, 221) formed thanks to the structure with the lower and upper compartments (21, 22) in the subject matter invention and they are substantially directed upwards and downwards. Thus, the pressure force which is formed as a result of hydrodynamic pressure and which may give harm to the walls of the container under normal conditions is minimized by being damped.

As it may be foreseen to be not as advantageous as the present embodiment, in an alternative embodiment of the present invention, the upper compartment may be embodied so as to have a bigger width and/or length than the lower compartment. Since thanks to this, the contact area between the container walls and the flexible tank will be decreased.

Figure 5:
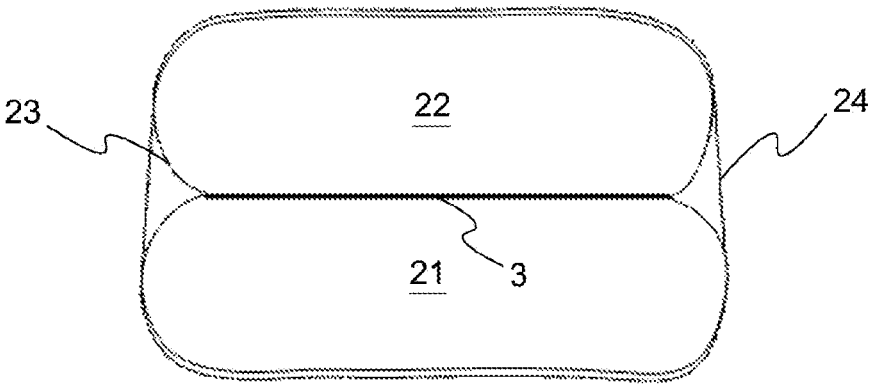
FIG. 5 is the representative view of an alternative embodiment of the invention.

With reference to FIG. 5, in another alternative embodiment of the present invention, a barrier (3) which will divide the inner volume of the tank into two separate compartments is applied to the flexible tank (2) which has only one compartment, thus the lower and the upper compartments (21, 22) are obtained. Said barrier (3) is welded to the inner layer (23) of the flexible tank and it is preferably selected from a thick (at least 500 microns) type of nylon.

The protection scope of the present invention is set forth in the annexed Claims and cannot be restricted to the illustrative disclosures given above, under the detailed description. It is because a person skilled in the relevant art can obviously produce similar embodiments under the light of the foregoing disclosures, without departing from the main principles of the present invention.

What is claimed is:

1. A flexible tank with a closed form to store and carry liquid from one location to the other by means of a vehicle container with a door, the flexible tank comprising; a lower compartment and an upper compartment for carrying liquid, the upper compartment having smaller width and length than the lower compartment, configured so that the upper compartment does not contact the vehicle container door, and the upper compartment and the lower compartment are positioned one upon the other so that the liquid transfer in between is at least partially prevented; an inner layer defining the lower and the upper compartments, said inner layer comprising a lower and an upper part fixed to each other to define the lower and the upper compartment respectively, an outer layer enclosing said inner layer, at least one connection member fixed to the lateral surfaces of the lower and the upper compartments from two ends.

2. The flexible tank of claim 1, wherein in order to completely eliminate the contact possibility of any surface of the upper compartment with the vehicle container door, said upper compartment is positioned closer to one side on the lower compartment.

3. The flexible tank of claim 1, further comprising at least one passage aperture, which provides liquid transfer between the lower compartment and the upper compartment (22).

4. The flexible tank of claim 3, wherein said passage apertures melt during the welding of the lower and the upper part to each other.

5. The flexible tank of claim 1, wherein the flexible tank is embodied so as not to let liquid passage between the lower compartment and the upper compartment.

6. The flexible tank of claim 5, further comprising a barrier extending lengthwise between the lower and the upper compartment in order to prevent liquid transfer.

7. The flexible tank of claim 1, wherein the lower and the upper parts forming said inner layer are comprised of plastic based material.

8. The flexible tank of claim 7, wherein said lower and upper parts are comprised of at least one of the group consisting of thermoplastic polypropylene (PP), polyethylene (PE) or PVC.

9. The flexible tank of claim 7, wherein at least one of said lower and upper parts comprises at least 2 layers, each comprising a thickness between 100 and 150 micron.

10. The flexible tank of claim 1, wherein at least one of said lower and upper parts comprises at least 2 layers, each comprising a thickness between 100 and 150 micron.

11. The flexible tank of claim 1, wherein said flexible tank further comprises a single layer, which has a substantial thickness, which provides a desired strength and which defines the lower and the upper compartment.

12. The flexible tank of claim 11, further comprising a plurality of connection members connecting the lower and the upper compartment from at least one point in order to substantially stabilize the lower and the upper compartment.

13. The flexible tank of claim 1, wherein said outer layer comprises woven polypropylene.

14. The flexible tank of claim 1, wherein at least one of the lower or the upper part of the inner layer is seamed to the outer layer from at least one seam point.

15. The flexible tank of claim 1, wherein at least one of said lower and upper compartments comprises a valve to provide liquid transfer to the flexible tank and a protective sheath, which covers said valve and which is connected to the inner layer.

* * * * *